US010771900B2

(12) United States Patent
Wang et al.

(10) Patent No.: US 10,771,900 B2
(45) Date of Patent: Sep. 8, 2020

(54) SPEAKER DIAPHRAGM STRUCTURE

(71) Applicants: FU JEN CATHOLIC UNIVERSITY, New Taipei (TW); MICRO LITHOGRAPHY INC., Hsinchu County (TW)

(72) Inventors: Ching-Bore Wang, Sunnyvale, CA (US); Chien-Sheng Chen, New Taipei (TW); Hao-Zhi Li, New Taipei (TW); Wei-Jen Lee, New Taipei (TW)

(73) Assignees: FU JEN CATHOLIC UNIVERSITY, New Taipei (TW); MICRO LITHOGRAPHY INC., Hsinchu County (TW)

( * ) Notice: Subject to any disclaimer, the term of this patent is extended or adjusted under 35 U.S.C. 154(b) by 0 days.

(21) Appl. No.: 16/544,646

(22) Filed: Aug. 19, 2019

(65) Prior Publication Data

US 2020/0077195 A1 Mar. 5, 2020

(30) Foreign Application Priority Data

Sep. 3, 2018 (TW) ..... 107130837 A

(51) Int. Cl.

| | |
|---|---|
| ***H04R 7/12*** | (2006.01) |
| ***H04R 31/00*** | (2006.01) |
| ***H04R 7/18*** | (2006.01) |

(52) U.S. Cl.

CPC ..... *H04R 7/125* (2013.01); *H04R 7/127* (2013.01); *H04R 7/18* (2013.01); *H04R 31/003* (2013.01); *H04R 2307/021* (2013.01); *H04R 2307/025* (2013.01); *H04R 2307/027* (2013.01); *H04R 2400/11* (2013.01)

(58) Field of Classification Search

CPC ..... H04R 7/125; H04R 7/18; H04R 7/127; H04R 31/003; H04R 2307/027; H04R 2400/11; H04R 2307/021; H04R 2307/025; H04R 7/12

See application file for complete search history.

(56) References Cited

U.S. PATENT DOCUMENTS

| | | | | |
|---|---|---|---|---|
| 10,178,477 | B2 * | 1/2019 | Wang | B32B 27/36 |
| 2015/0136518 | A1 * | 5/2015 | Lin | H04R 7/125 181/157 |
| 2015/0256937 | A1 * | 9/2015 | Lin | H04R 7/125 381/396 |

* cited by examiner

*Primary Examiner* — Brian Ensey
(74) *Attorney, Agent, or Firm* — Chun-Ming Shih; LanWay IPR Services

(57) ABSTRACT

A speaker diaphragm structure is installed inside a sound generator device which comprises a frame, a speaker diaphragm structure installed within the frame and a suspension edge whose inner perimeter is connected to the speaker diaphragm structure and whose outer perimeter is connected to the frame; herein the speaker diaphragm structure includes a diaphragm body and a composite material layer, in which the composite material layer is used for bonding onto the surface of the diaphragm body or attaching within the diaphragm body; moreover, the composite material layer is composed of one or more types of tetrapyrrole compounds as well as one or more types of metal ions; additionally, the composite material layer has a thickness smaller than the thickness of the diaphragm body, and is mainly applied to provide the performance effect of sound quality modifications.

9 Claims, 6 Drawing Sheets

SPEAKER DIAPHRAGM STRUCTURE

BACKGROUND OF THE INVENTION

1. Field of the Invention

The present invention generally relates to a speaker diaphragm structure; in particular, it relates to a speaker diaphragm structure capable of providing modification of sound quality.

2. Description of Related Art

The speaker is a type of device converting electrical energy into sound. Typically, the structure of the speaker includes a frame, a magnetic component, a diaphragm and a suspension edge, etc. The suspension edge is connected to the diaphragm and the frame such that the diaphragm can vibrate on the frame, and the magnetic force generated by the magnetic component can push the diaphragm so as to generate sound.

Accordingly, when the diaphragm vibrates, the generated vibration waves will propagate outwards along the diaphragm to the suspension edge. However, most speakers are difficult to enable proper impedance matches between the suspension edge and the diaphragm, and, when the vibration waves reach the suspension edge, the energy of the vibration waves cannot be surely eliminated, so that the vibration waves rebound again into the diaphragm, thus undesirably creating residual vibration waves.

It is appreciated that, at present, computer speakers and mobile phone speakers represent the main development directions in relevant industries. For Apple computers, one of the major evaluation conditions with regard to speakers is the environmental protection, so their production processes should not apply poisonous materials and halides, and various diaphragm materials can be illustrated as below:

(1) The diaphragm is made of natural materials, in which natural cellulose and silk are common sources of environmental friendly materials. Such products are often used in standalone speakers on the market.

(2) The diaphragm contains synthetic woven fabrics in this type of products, in which traditional textile techniques are applied to weave modern high-quality loudspeakers.

(3) The diaphragm is a polymer film, which represents the mainstream product of practical grade on the market. Modern manufacturing processes can be utilized to laminate a variety of polymers or metals of different materials (e.g., metals such as aluminum or beryllium etc.) in order to improve sound quality performance.

Therefore, no matter which kind of material is used in the diaphragm, the sound quality performance is definitely the key factor for the market demand. In addition, moderate fine-tuning of the sound frequency can improve the sound quality. But, to suitably fine-tune the presentation quality of the sound, the present application combines at least one tetrapyrrole compound layer on or within the surface of the diaphragm, and after spectrum analyses, the effects of sound quality modifications can be successfully achieved. As such, the added tetrapyrrole compound layer allows to offer the intended presentation effect of sound quality modifications, thereby, effectively providing an appropriate solution.

SUMMARY OF THE INVENTION

A speaker diaphragm structure according to the present invention is disclosed, wherein the speaker diaphragm structure is installed within a sound generator device which comprises a frame, a speaker diaphragm structure installed within the frame and a suspension edge whose inner perimeter is connected to the speaker diaphragm structure and whose outer perimeter is connected to the frame; herein the speaker diaphragm structure includes: a diaphragm body; and a composite material layer, in which the composite material layer is used for bonding onto the surface of the diaphragm body or attaching within the diaphragm body; moreover, the composite material layer is composed of one or more types of tetrapyrrole compounds as well as one or more types of metal ions; additionally, the composite material layer has a thickness smaller than the thickness of the diaphragm body.

More specifically, the molar mixture ratio of the tetrapyrrole compound to the metal ions ranges from 0.2 to 20.

More specifically, the diaphragm body is a polymer film, a polymer cloth, a woven cloth or a cellulose composite material film.

More specifically, in case the diaphragm body is a polymer film, the mixture ratio of the tetrapyrrole compound to the diaphragm body ranges from $2\times10^{-5}$–$4\times10^{-3}$.

More specifically, the cellulose composite material film contains at least one or more types of cellulose, hemicellulose, lignin, wool, cotton, wood and/or wood fiber, and the cellulose composite material film can be also manufactured with paper formed by means of one or more types of cellulose, hemicellulose and/or lignin.

More specifically, in case the diaphragm body is made of wood fibers, the mixture ratio of the tetrapyrrole compound to the diaphragm body ranges from $10^{-4}$–$4\times10^{-3}$.

More specifically, in case the diaphragm body is made of paper, the mixture ratio of the tetrapyrrole compound to the diaphragm body ranges from $2\times10^{-5}$–$4\times10^{-3}$.

More specifically, the tetrapyrrole compound is a porphin compound or sodium copper chlorophyllin.

More specifically, the metal ions are magnesium, calcium, nickel, copper, zinc, silver, gold, aluminum or zirconium.

DETAILED DESCRIPTION OF THE PREFERRED EMBODIMENTS

Other technical contents, aspects and effects in relation to the present invention can be clearly appreciated through the detailed descriptions concerning the preferred embodiments of the present invention in conjunction with the appended drawings.

Figure 1:
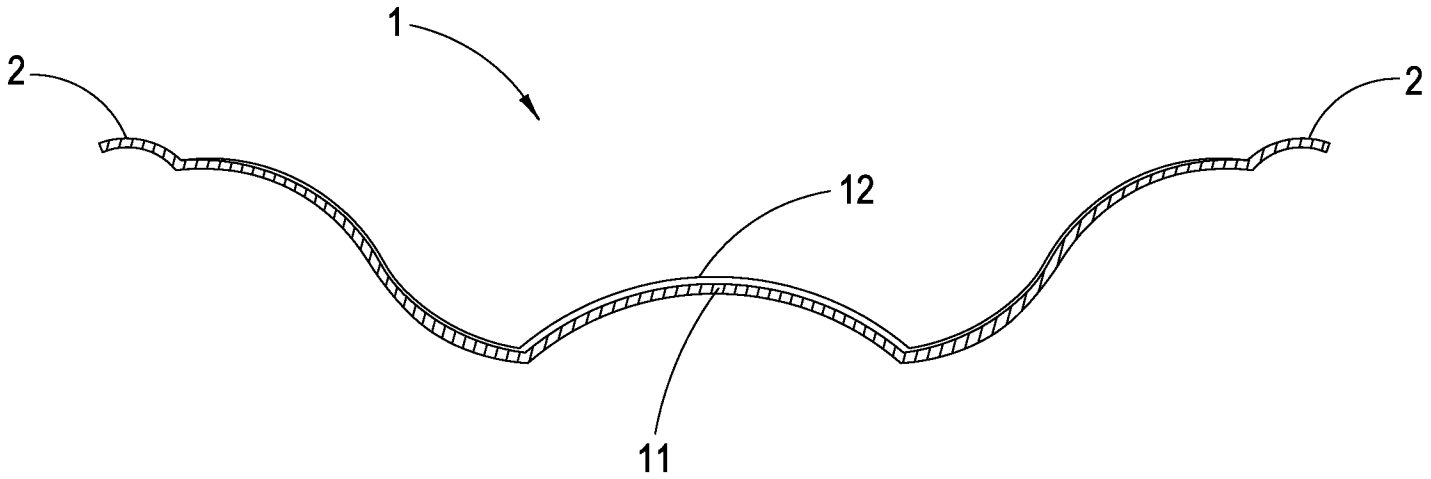
FIG. 1 shows a structural view of the present invention applicable to a speaker.

Refer initially to FIG. 1, wherein a structural view of the present invention is shown. As illustrated in the Figure, the surface of the diaphragm body 11 can be combined with a composite material layer 12, wherein the diaphragm body 11 can be a polymer film, a polymer cloth, a woven cloth or a cellulose composite film (herein the cellulose composite film may be made from one or more types of cellulose, hemicellulose, lignin, wool, cotton, wood or wood fibers, or otherwise manufactured by means of papers containing one or more kinds of cellulose, hemicellulose and/or lignin.)

Besides, the composite material layer 12 is composed of one or more sorts of tetrapyrrole compounds as well as one or more kinds of metal ions, and the thickness of the composite material layer 12 is smaller than the thickness of the diaphragm body 11; in particular, the tetrapyrrolole compound of the composite material layer 12 may be a porphine compound, sodium copper chlorophyllin or sodium magnesium chlorophyllin, and the metal ions in the composite material layer 12 may be of magnesium, calcium, nickel, copper, zinc, silver, gold, aluminum or zirconium.

In case the diaphragm body is a polymer film, the range of the mixture ratio for the tetrapyrrole compound to the diaphragm body (weight/weight) may be $2\times10^{-5}$–$4\times10^{-3}$ (e.g., $2\times10^{-5}$, $3\times10^{-5}$, $4\times10^{-5}$, $5\times10^{-5}$, $6\times10^{-5}$, $7\times10^{-5}$, $8\times10^{-5}$, $9\times10^{-5}$, $10^{-4}$, $2\times10^{-4}$, $3\times10^{-4}$, $4\times10^{-4}$, $5\times10^{-4}$, $6\times10^{-4}$, $7\times10^{4}$, $8\times10^{-4}$, $9\times10^{-4}$, $10^{-3}$, $2\times10^{-3}$, $3\times10^{-3}$, $4\times10^{-3}$), and the range of the mixture ratio for the tetrapyrrole compound to the metal ions (molar/molar) may be 0.2-20 (e.g., 0.2, 0.5, 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20).

In case the diaphragm body is a cellulose composite material film (made of wood fibers), the range of the mixture ratio for the tetrapyrrole compound to the diaphragm body (weight/weight) may be $10^{-4}$–$4\times10^{-3}$ (e.g., $10^{-4}$, $2\times10^{-4}$, $3\times10^{-4}$, $4\times10^{-4}$, $5\times10^{-4}$, $6\times10^{-4}$, $7\times10^{-4}$, $8\times10^{-4}$, $9\times10^{-4}$, $10^{--3}$, $2\times10^{-3}$, $3\times10^{-3}$, $4\times10^{-3}$), and the range of the mixture ratio for the tetrapyrrole compound to the metal ions (molar/molar) may be 0.2-20 (e.g., 0.2, 0.5, 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20).

Moreover, in case the diaphragm body is a cellulose composite material film (made of papers), the range of the mixture ratio for the tetrapyrrole compound to the diaphragm body (weight/weight) may be $2\times10^{-5}$–$4\times10^{-3}$ (e.g., $2\times10^{-5}$, $3\times10^{-5}$, $4\times10^{-5}$, $5\times10^{-5}$, $6\times10^{-5}$, $7\times10^{-5}$, $8\times10^{-5}$, $9\times10^{-5}$, $10^{-4}$, $2\times10^{-4}$, $3\times10^{-4}$, $4\times10^{-4}$, $5\times10^{-4}$, $6\times10^{-4}$, $7\times10^{-4}$, $8\times10^{-4}$, $9\times10^{-4}$, $10^{-3}$, $2\times10^{-3}$, $3\times10^{-3}$, $4\times10^{-3}$), and the range of the mixture ratio for the tetrapyrrole compound to the metal ions (molar/molar) may be 0.2-20 (e.g., 0.2, 0.5, 1, 1.5, 2, 2.5, 3, 3.5, 4, 4.5, 5, 5.5, 6, 6.5, 7, 7.5, 8, 8.5, 9, 9.5, 10, 10.5, 11, 11.5, 12, 12.5, 13, 13.5, 14, 14.5, 15, 15.5, 16, 16.5, 17, 17.5, 18, 18.5, 19, 19.5, 20).

Figure 2:
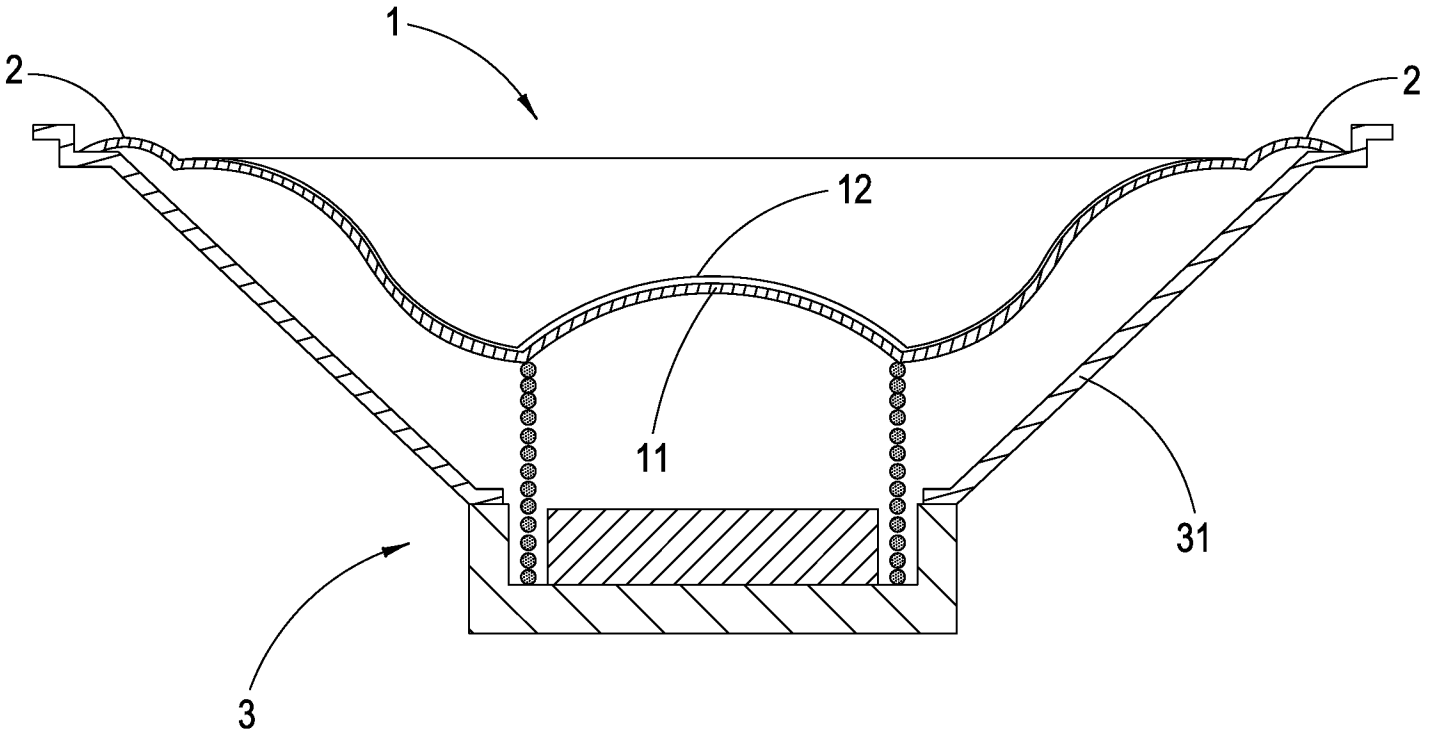
FIG. 2 shows a view of the speaker diaphragm structure according to the present invention in combination with a speaker.

Furthermore, the speaker diaphragm structure 1 according to the present invention may be installed inside a sound generator device, which may be a speaker, a speaker box or a headphone device. Therefore, when the speaker diaphragm structure 1 is applied to a speaker 3, as shown in FIG. 2, the speaker 3 includes at least one frame 31, wherein the speaker diaphragm structure 1 is disposed within the frame 31, and the outer periphery of the suspension edge 2 is connected to the frame 31, while the inner periphery thereof is connected to the outer periphery of the speaker diaphragm structure 1, in which the speaker diaphragm structure 1 can utilize the flexibility of the suspension edge 2 to vibrate on the frame 31.

Figure 3:
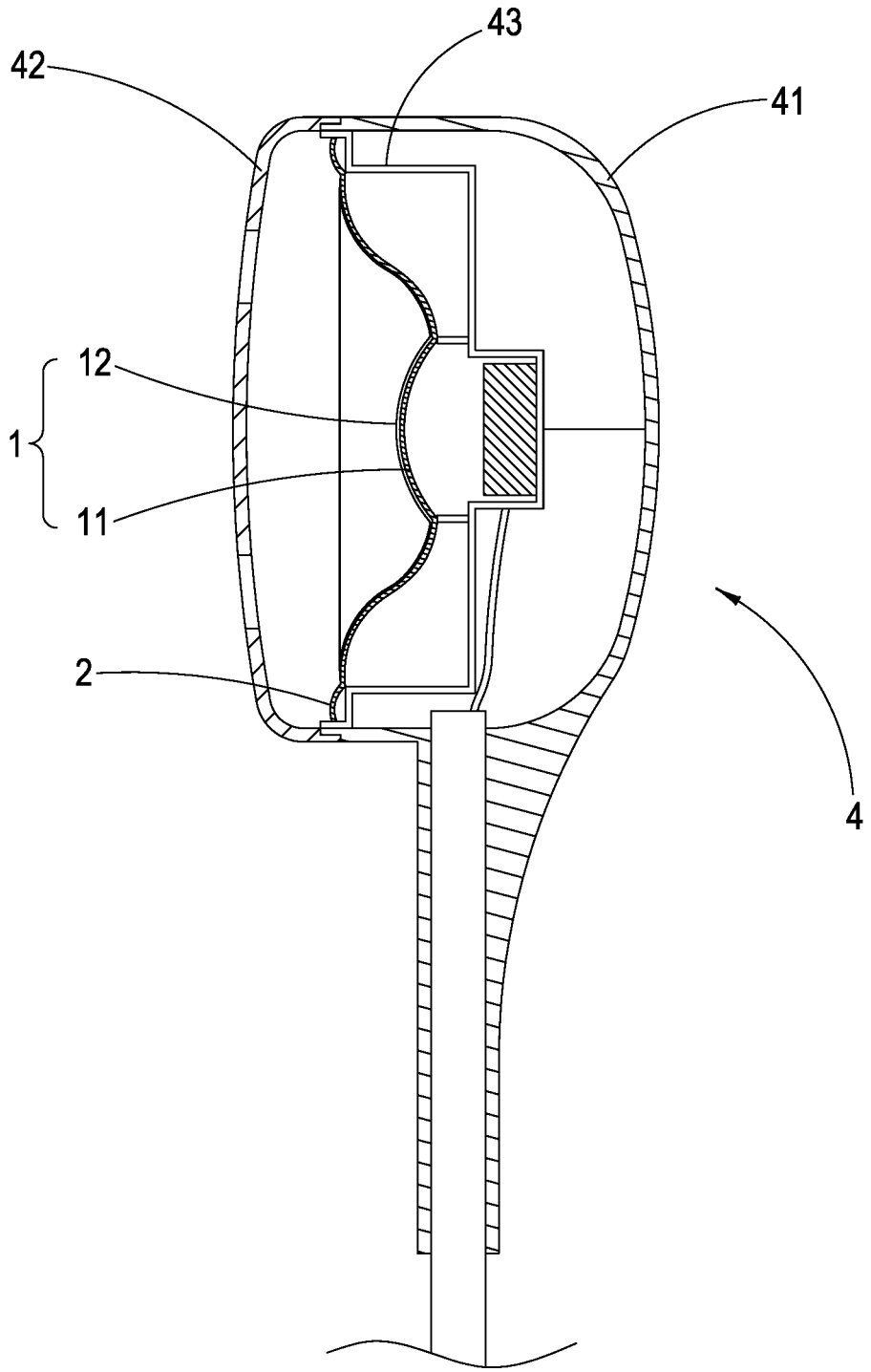
FIG. 3 shows a view of the speaker diaphragm structure according to the present invention in combination with a headphone.

Or alternatively, when the speaker diaphragm structure 1 is applied to a headphone structure 4, as shown in FIG. 3, the headphone structure 4 includes an outer case 41 and an earmuff 42, there is a space between the outer case 41 and the earmuff 42, and the space includes at least a frame 43. Herein the speaker diaphragm structure 1 is disposed within the frame 43 and the outer periphery of the suspension edge 2 is connected to the frame 43, while the inner periphery of the suspension edge 2 is connected to the speaker diaphragm structure 1, in which the speaker diaphragm structure 1 can utilize the flexibility of the suspension edge 2 to vibrate on the frame 43.

In addition, in order to enable the speaker 1 to operate normally, the speaker 1 may comprise other components (e.g., various magnets, coils, elastic waves or the like). In the case of magnets and coils, for example, they may be essentially installed between the frame and the speaker diaphragm structure, thus generating a magnetic force that attracts or repels so as to compress the air to generate sound waves, such that the speaker diaphragm structure may be pushed to move in the axial direction of the coil; also, and the main feature of the elastic waves is to support and position the overall vibration system. It can be understood that, in addition to the above-mentioned components, the sound generator devices may have certain variations in terms of components due to different functions. Hence, the structures of such conventional sound generator devices are not specifically described in the present application, and all sound generator devices having the diaphragm accordingly fall within the legally protected scope of the present invention.

Furthermore, in order to enable the composite material layer 12 to be bonded to the diaphragm body 11, it is necessary to initially use an organic mixed solvent (including at least one of the cyanomethane, cyanoethane, dimethyl hydrazine, nitromethane or propylene glycol, or at least two of them for mixture) such that the tetrapyrrole compound is dissolved and mixed with the metal ions so as to form a mixed liquid, and then bonded to the diaphragm body 11 in different manners depending on the material of the diaphragm body 11. One exemplary method can be provided as below (the following approach can be performed on the prepared diaphragm body 11 or else added in the preparation process of the diaphragm body 11):

(1) For the diaphragm body 11 of the polymer film, it can be smeared to cover the surface of the diaphragm body 11, and then attached to the surface of the diaphragm body 11 after being dried.

(2) For the diaphragm body 11 of the cellulose composite material film, the dissolved components are incorporated into the diaphragm body 11 by adsorption.

(3) For the diaphragm body 11 of the cellulose composite film, a liquid in which the tetrapyrrole compound and the metal ions are mixed can be sprayed onto the top end of the diaphragm body 11 and uniformly absorbed by means of a low-speed centrifugation process for a period of time. It is then dried in an oven at a low temperature or room temperature for a while and finally dried at room temperature.

Figure 4:
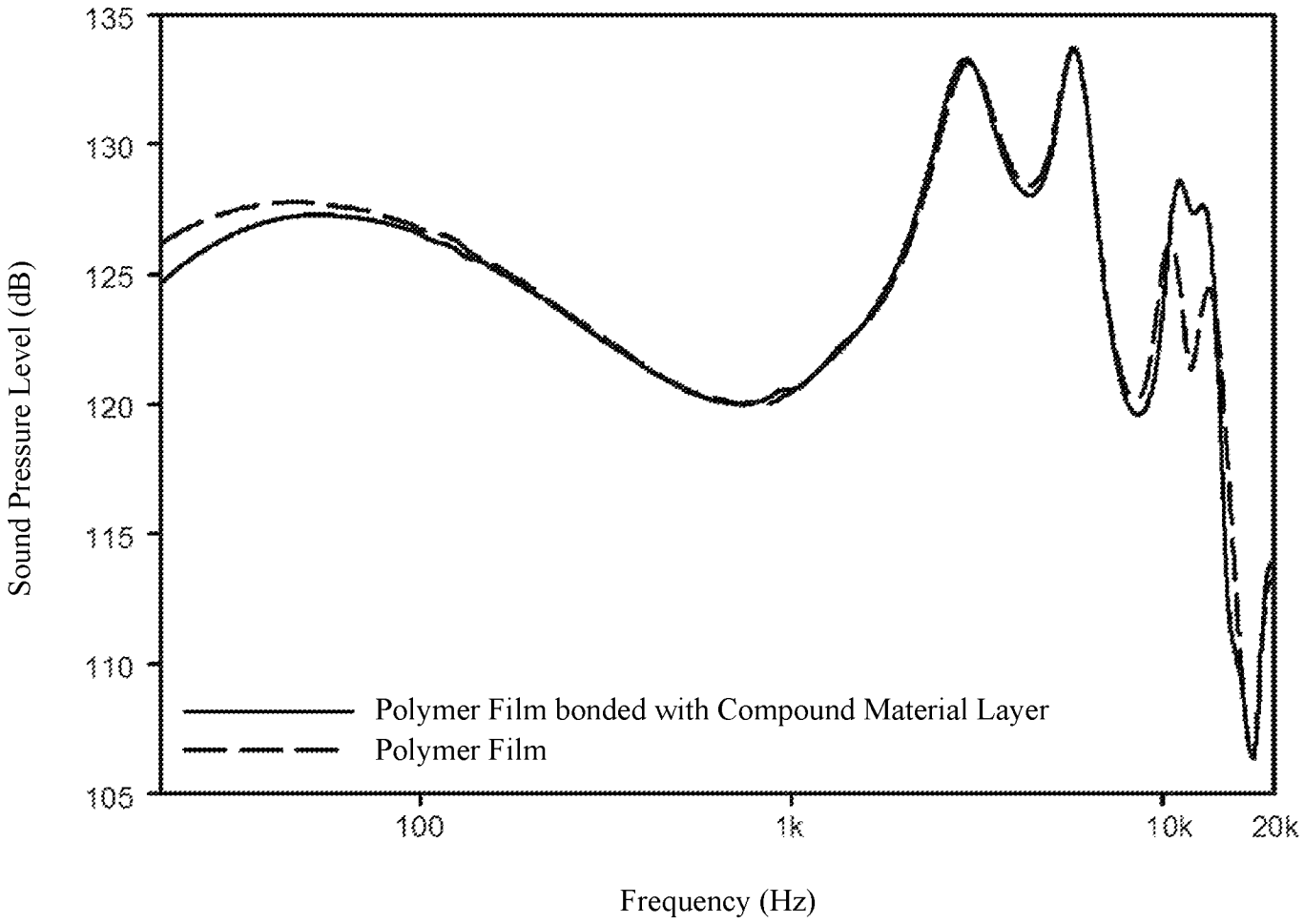
FIG. 4 shows a diagram of the diaphragm spectrum analysis for a first embodiment of the speaker diaphragm structure according to the present invention.

The polymer film as well as the polymer film bonded with the composite material layer 12 are subjected to our spectrometer analyses (in which the tetrapyrrole compound is copper chlorophyll sodium and the metal ion is copper), and the mixture ratio (weight/weight) of the tetrapyrrole compound to the diaphragm body in the present embodiment is $2\times10^{-5}$–$4\times10^{-3}$ , whose spectrum comparison diagram of the analyzed diaphragm thereof is shown in FIG. 4, and the differences are analyzed and illustrated as below:

(1) the dotted line represents the diaphragm body (polymer film), and it can be seen that, when the high frequency range is between 10 kHz-16 kHz, a steep drop will occur; in particular, while the treble frequency goes to approximately 14 kHz, the treble decibel drops sharply to 122 dB, meaning its sound quality is very unstable; and at 20 kHz, it can be found that the trend of continued decline in treble decibels didn't stop;

(2) meanwhile, the solid line indicates the diaphragm body (the polymer film bonded with a tetrapyrrole compound layer), and a steep drop also occurs between the high frequency regions of 10 kHz-16 kHz, but this steep drop tendency is not obvious; especially, when the frequency is around 14 kHz, the treble decibel will stay at 127 dB, meaning the bonded composite material layer 12 effectively enables a deterrent effect on the high-pitched attenuation state in the 10 kHz-16 kHz high frequency regions.

Figure 5:
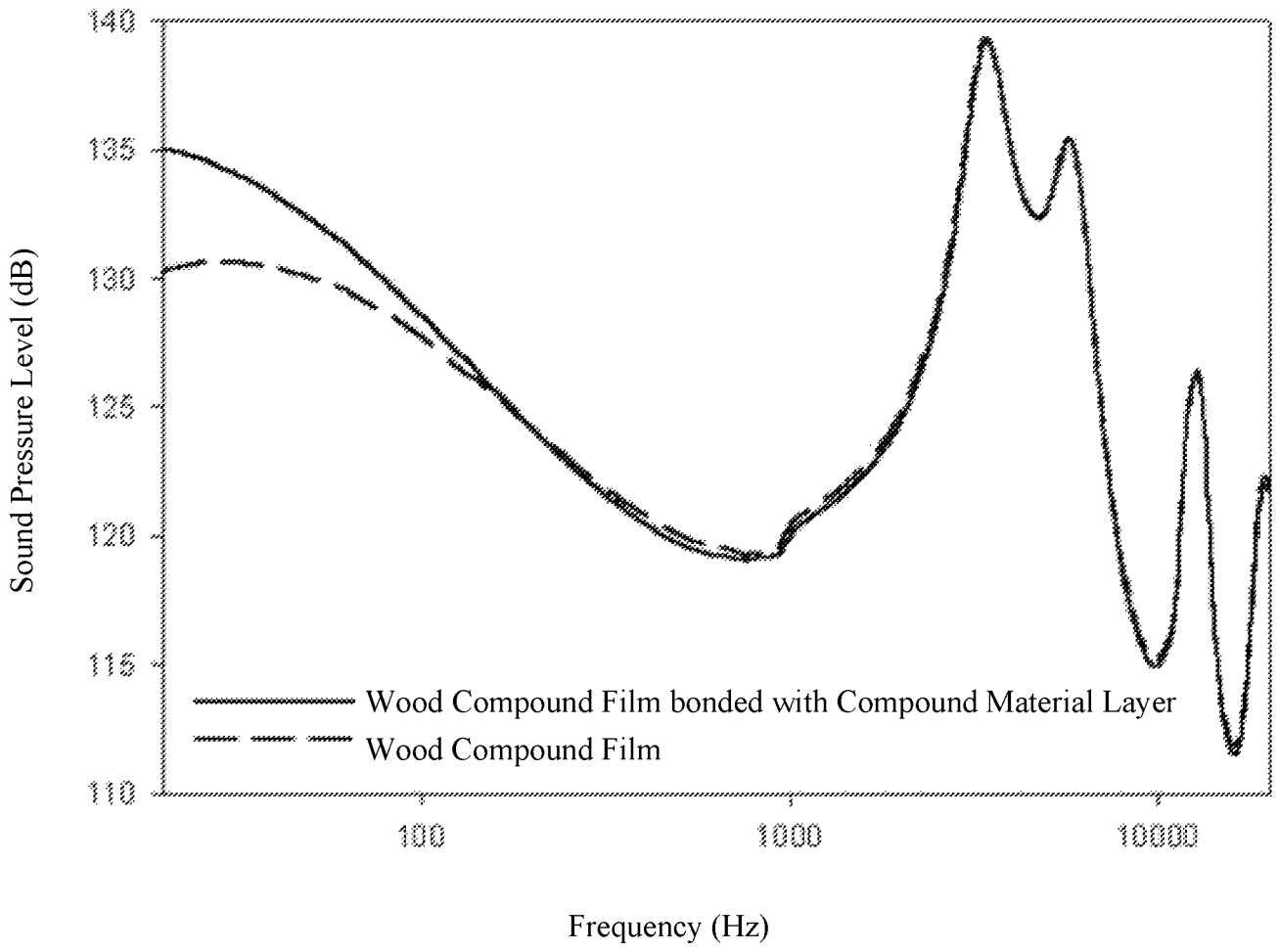
FIG. 5 shows a diagram of the diaphragm spectrum analysis for a second embodiment of the speaker diaphragm structure according to the present invention.

Moreover, the cellulose composite material film used in the present embodiment includes at least wood fibers, so the following descriptions of the cellulose composite material film is briefly referred to as a wood composite film, and the wood composite film and the bonded composite material layer 12 are analyzed by a spectrometer (wherein the tetrapyrrole compound is copper chlorophyll sodium and the metal ion is copper), and the mixture ratio (weight/weight) of the tetrapyrrole compound to the diaphragm body in the present embodiment is $10^{-4}$–$4\times10^{-3}$, whose spectrum comparison diagram of the analyzed diaphragm thereof is shown in FIG. 5, and the differences are analyzed and illustrated as below:

(1) the dotted line represents the diaphragm body (i.e., the wood composite film), and the sound pressure level (SPL) thereof is reduced between low and middle sound regions below 1 kHz;

(2) meanwhile, the solid line indicates the diaphragm body (i.e., the wood composite film bonded with a tetrapyrrole compound layer), and the sound pressure level (SPL) can be increased by approximately 5 dB between the low and middle sound regions below 1 kHz, so less work voltage is needed to drive greater volume, meaning its sound quality can be better than the pure wood composite film; besides, the reduction trend and its extent can be slowed down, so the bonded composite layer indeed allows to significantly improve the low-middle pitched sound quality below 1 kHz.

Figure 6:
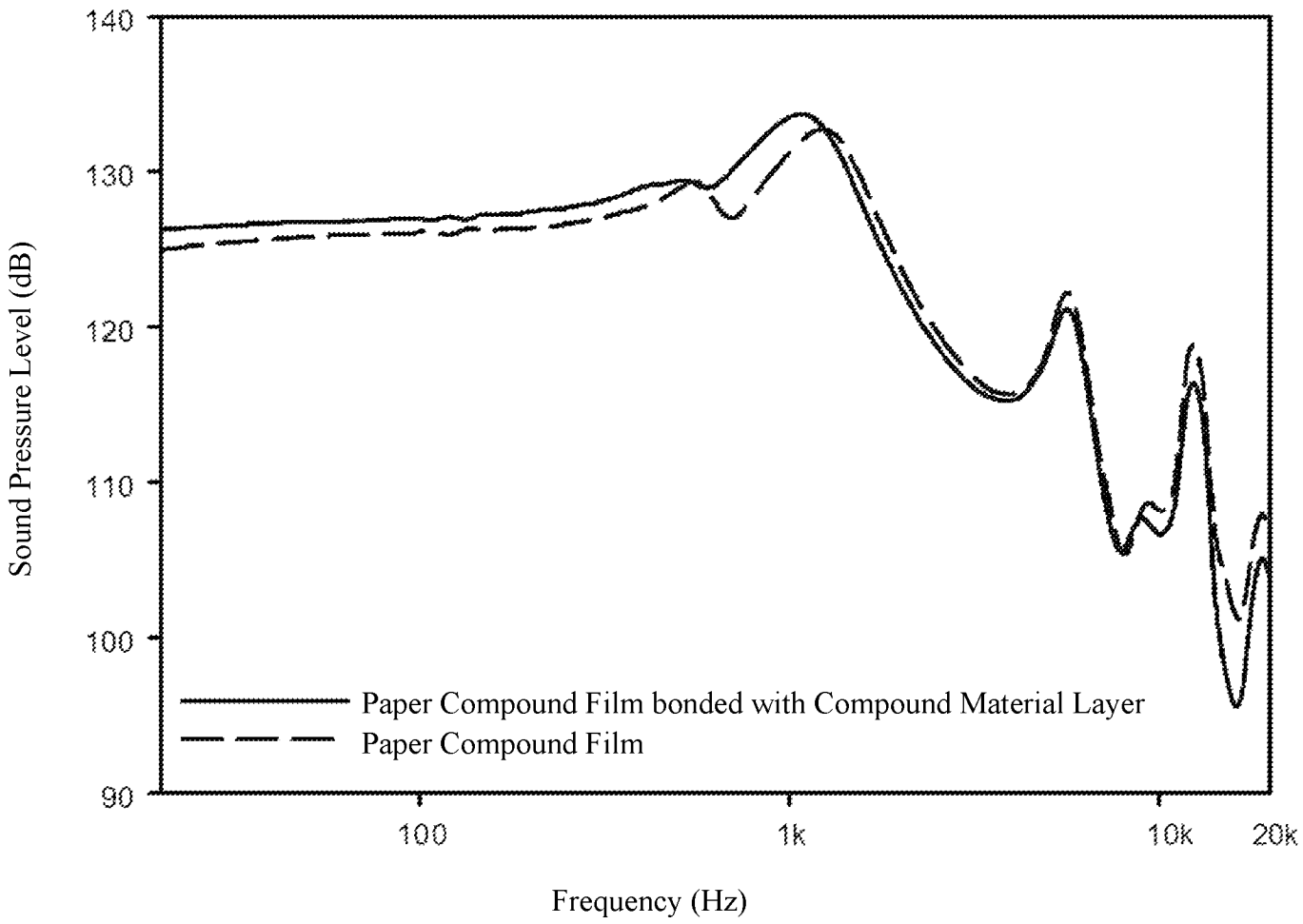
FIG. 6 shows a diagram of the diaphragm spectrum analysis for a third embodiment of the speaker diaphragm structure according to the present invention.

Furthermore, the cellulose composite material film used in the present embodiment contains at least cellulose, hemicellulose and/or lignin (it is also possible to add one or more types of wool, cotton or wood as required), so the following descriptions briefly refer the cellulose composite material film as a paper composite film, and the cellulose composite material film (i.e., the paper composite film) and the paper film bonded with a composite material layer 12 are analyzed by a spectrometer (wherein the tetrapyrrole compound is copper chlorophyll sodium and the metal ion is copper); similarly, the mixture ratio (weight/weight) of the tetrapyrrole compound to the diaphragm body in the present embodiment is $2\times10^{-5}$–$4\times10^{-3}$, whose spectrum comparison diagram of the analyzed diaphragm thereof is shown in FIG. 6, and the differences are analyzed and illustrated as below:

(1) the dotted line represents the diaphragm body (i.e., the paper composite film), and its sound pressure level (SPL) is reduced between the vocal areas below 2 kHz;

(2) on the other hand, the solid line indicates the diaphragm body (i.e., the paper composite film bonded with a tetrapyrrole compound layer), and the sound pressure level (SPL) can be increased by approximately 1.5-2 dB between the low-middle sound regions below 2 kHz, so less work voltage is needed to drive greater volume, meaning its sound quality can be better than the pure paper composite film; in addition, the reduction trend and its extent can be slowed down, so the bonded composite layer indeed allows to significantly improve the low-middle pitched sound quality below 2 kHz.

In comparison with other conventional technologies, the speaker diaphragm structure according to the present invention provides the following advantages:

(1) The present invention is characterized in that a composite material layer containing a tetrapyrrole compound and a metal ion is bonded onto the surface of the diaphragm, and, through spectrum analyses, it can be observed that the present invention successfully achieves the high-pitched sound quality modification effects to the diaphragm body of the polymer film.

(2) Also, the present invention is capable of bonding a composite material layer comprising a tetrapyrrole compound and a metal ion onto the surface of the diaphragm, and, after spectrum analyses, it can be observed that the present invention successfully achieves the low-middle-pitched sound quality modification effects to the diaphragm body of the cellulose composite material film.

It should be noticed that, although the present invention has been disclosed through the detailed descriptions of the aforementioned embodiments, such illustrations are by no means used to restrict the scope of the present invention; that is, skilled ones in relevant fields of the present invention can certainly devise any applicable alternations and modifications after having comprehended the aforementioned technical characteristics and embodiments of the present invention without departing from the spirit and scope thereof. Hence, the scope of the present invention to be protected under patent laws should be delineated in accordance with the claims set forth hereunder in the present specification.

What is claimed is:

1. A speaker diaphragm structure installed within a sound generator device which comprises a frame, a speaker diaphragm structure installed within the frame, and a suspension edge whose inner perimeter is connected to the speaker diaphragm structure and whose outer perimeter is connected to the frame; herein the speaker diaphragm structure includes:

a diaphragm body; and a composite material layer, in which the composite material layer is used for bonding onto the surface of the diaphragm body or attaching within the diaphragm body, and the composite material layer is composed of one or more types of tetrapyrrole compounds as well as one or more types of metal ions; additionally, the composite material layer has a thickness smaller than the thickness of the diaphragm body.

2. The speaker diaphragm structure according to claim 1, wherein the molar mixture ratio of the tetrapyrrole compound to the metal ions ranges from 0.2 to 20.

3. The speaker diaphragm structure according to claim 1, wherein the diaphragm body is a polymer film, a polymer cloth, a woven cloth or a cellulose composite material film.

4. The speaker diaphragm structure according to claim 3, wherein, in case the diaphragm body is a polymer film, the mixture ratio of the tetrapyrrole compound to the diaphragm body ranges from $2\times10^{-5}$–$4\times10^{-3}$.

5. The speaker diaphragm structure according to claim 3, wherein the cellulose composite material film contains at least one or more types of cellulose, hemicellulose, lignin, wool, cotton, wood and/or wood fiber, and the cellulose composite material film can be also manufactured with paper formed by means of one or more types of cellulose, hemicellulose and/or lignin.

6. The speaker diaphragm structure according to claim 5, wherein, in case the diaphragm body is made of wood fibers, the mixture ratio of the tetrapyrrole compound to the diaphragm body ranges from $10^{-4}$–$4\times10^{-3}$.

7. The speaker diaphragm structure according to claim 5, wherein, in case the diaphragm body is made of paper, the mixture ratio of the tetrapyrrole compound to the diaphragm body ranges from $2\times10^{-5}$–$4\times10^{-3}$.

8. The speaker diaphragm structure according to claim 1, wherein the tetrapyrrole compound is a porphin compound or sodium copper chlorophyllin.

9. The speaker diaphragm structure according to claim 1, wherein the metal ions are magnesium, calcium, nickel, copper, zinc, silver, gold, aluminum or zirconium.

* * * * *